US010158950B2

(12) United States Patent
Hu

(10) Patent No.: US 10,158,950 B2
(45) Date of Patent: Dec. 18, 2018

(54) CYLINDRICAL CONTACT-TYPE MICROPHONE

(71) Applicant: Qiang Hu, Shanghai (CN)

(72) Inventor: Qiang Hu, Shanghai (CN)

( * ) Notice: Subject to any disclaimer, the term of this patent is extended or adjusted under 35 U.S.C. 154(b) by 0 days.

(21) Appl. No.: 15/763,349

(22) PCT Filed: Jul. 14, 2016

(86) PCT No.: PCT/CN2016/000383

§ 371 (c)(1),
(2) Date: Mar. 26, 2018

(87) PCT Pub. No.: WO2017/071109

PCT Pub. Date: May 4, 2017

(65) Prior Publication Data

US 2018/0279054 A1 Sep. 27, 2018

(30) Foreign Application Priority Data

Oct. 26, 2015 (CN) ..... 2015 1 0699414

(51) Int. Cl.
*H04R 17/02* (2006.01)
*H04R 1/04* (2006.01)
(Continued)

(52) U.S. Cl.
CPC ..... *H04R 17/02* (2013.01); *H04R 1/04* (2013.01); *H04R 1/08* (2013.01); *H04R 3/00* (2013.01);
(Continued)

(58) Field of Classification Search
CPC ..... H04R 17/02; H04R 17/025; H04R 1/021; H04R 1/04; H04R 1/08; H04R 1/083;
(Continued)

(56) References Cited

U.S. PATENT DOCUMENTS 3,439,128 A * 4/1969 Didyk ..... H04R 17/02 310/324
3,710,040 A * 1/1973 Swinehart ..... H04R 17/02 310/312
(Continued)

FOREIGN PATENT DOCUMENTS

CN 201114760 9/2008
CN 201215970 4/2009
(Continued)

*Primary Examiner* — Joshua Kaufman
(74) *Attorney, Agent, or Firm* — Schmeiser, Olsen & Watts, LLP

(57) ABSTRACT

A cylindrical contact-type microphone relates to the technical field of audio devices, and solves the technical problem of inconvenient assembly of an existing contact-type microphone. The microphone comprises a shell, and a circuit board (4), a piezoelectric ceramic sheet (2), a lower-stage connection plate (3) and a conductive polar ring (5) which are mounted within the shell, wherein the shell is a two-section cylindrical conductive cylinder body, and a negative signal lower connection sheet of the lower-stage connection plate (3) is electrically connected to a step (13) at a joint portion of an upper cylinder section (11) and a lower cylinder section (12) of the shell.

2 Claims, 2 Drawing Sheets

(51) Int. Cl.
*H04R 7/04* (2006.01)
*H04R 1/08* (2006.01)
*H04R 3/00* (2006.01)
*H04R 1/02* (2006.01)

(52) U.S. Cl.
CPC ..... *H04R 7/04* (2013.01); *H04R 1/021* (2013.01); *H04R 2201/029* (2013.01); *H04R 2307/023* (2013.01)

(58) Field of Classification Search
CPC ..... H04R 3/00; H04R 7/04; H04R 2201/029; H04R 2307/023
See application file for complete search history.

(56) References Cited

U.S. PATENT DOCUMENTS 4,012,604 A * 3/1977 Speidel ..... A61B 5/021 181/171
4,535,205 A * 8/1985 Ravinet ..... H04R 17/025 367/163
4,607,145 A * 8/1986 Ravinet ..... H04R 1/04 381/190
5,742,697 A * 4/1998 Ching-Chung ..... H04R 1/083 381/355
5,778,079 A * 7/1998 Wun ..... H04R 17/02 381/151
6,091,828 A * 7/2000 Akino ..... H04R 9/08 381/170
6,128,393 A * 10/2000 Kondo ..... H04R 9/08 381/355
6,226,386 B1 * 5/2001 Akino ..... H04R 3/00 381/114
6,389,140 B1 * 5/2002 Wei ..... H04R 1/14 381/151
6,463,157 B1 10/2002 May
6,693,849 B1 * 2/2004 Eberl ..... H04R 17/02 367/157
6,748,091 B2 * 6/2004 Hohjyo ..... H04R 19/04 381/174
8,213,643 B2 * 7/2012 Hemer ..... H04R 17/00 381/151
9,107,014 B2 * 8/2015 Tang ..... H04R 25/606
9,900,684 B2 * 2/2018 Sano ..... H04R 1/2876
2009/0238392 A1 * 9/2009 Akino ..... H04R 1/2807 381/360
2010/0172519 A1 * 7/2010 Kimura ..... H04R 1/1008 381/151
2012/0140972 A1 * 6/2012 Akino ..... H04R 3/04 381/356
2015/0104044 A1 * 4/2015 Lee ..... H04R 1/08 381/120

FOREIGN PATENT DOCUMENTS

CN 1052455984 1/2016
CN 205105359 3/2016

* cited by examiner

CYLINDRICAL CONTACT-TYPE MICROPHONE

FIELD OF THE INVENTION

The present invention relates to the technology of audio devices, and more particularly, to the technology of a cylindrical contact-type microphone.

BACKGROUND OF THE INVENTION

Most of the traditional microphones are electret microphones. For such microphones, as sounds are converted into electric signals via electret diaphragms, sound pick-up effects are poor when environmental noises are loud.

For piezoelectric microphones, as vibrations produced by sounds are converted into electric signals via piezoelectric ceramic sheets, sound pick-up effects are excellent in a noisy environment. However, existing piezoelectric microphones are complex in structure and large in size, which renders assembly inconvenient. Moreover, as their machining manners are greatly different from those of traditional electret microphones, additional devices are required to be purchased for production and machining, which increases production costs of microphone manufacturing enterprises.

SUMMARY OF THE INVENTION

In view of the above drawbacks existing in the prior art, the technical problem to be solved by the present invention is to provide a cylindrical contact-type microphone that is simple in structure, small in size and convenient in assembly, and may reduce production costs of enterprises.

In order to solve the above technical problem, the cylindrical contact-type microphone provided by the present invention is characterized by comprising a shell and a circuit board mounted within the shell, and it is further characterized by comprising a piezoelectric ceramic sheet;

the shell is a tapered, two-section cylindrical conductive cylinder body, a step is formed at a joint portion of an upper cylinder section and a lower cylinder section of the shell, and a lower-stage connection plate and a conductive polar ring are mounted within the upper cylinder section of the shell;

a via-hole is arranged in the middle of the lower-stage connection plate, a positive signal lower connection sheet is secured to an upper plate face edge portion of the lower-stage connection plate, and a negative signal lower connection sheet is secured to a lower plate face edge portion of the lower-stage connection plate, wherein the negative signal lower connection sheet is pressed against the step at the joint portion of the upper cylinder section and the lower cylinder section of the shell, and forms electrical connection therewith;

the conductive polar ring is an annular conductor, and mounted on the lower-stage connection plate; a bottom edge of the conductive polar ring is pressed against the positive signal lower connection sheet on the lower-stage connection plate and forms electrical connection therewith, and the periphery of the conductive polar ring is sleeved with an insulated annular separation ring;

the piezoelectric ceramic sheet is inserted into the shell, an upper end of the piezoelectric ceramic sheet passes through the central via-hole of the lower-stage connection plate, a positive electrode of the piezoelectric ceramic sheet is connected to the positive signal lower connection sheet of the lower-stage connection plate, and a negative electrode of the piezoelectric ceramic sheet is connected to the negative signal lower connection sheet of the lower-stage connection plate;

the circuit board is mounted on the upper end of the conductive polar ring, a positive signal upper connection sheet: is secured to a lower board face of the circuit board, and a negative signal upper connection sheet is secured to an upper board face of the circuit board, wherein the positive signal upper connection sheet is pressed against an upper edge of the conductive polar ring and forms electrical connection therewith;

an upper edge of the shell is bent inward, and pressed against the negative signal upper connection sheet on the circuit board to form electrical connection therewith.

Further, a weight block is secured to a lowerend of the piezoelectric ceramic sheet.

The cylindrical contact-type microphone provided by the present invention employs a structure similar to that of an electret microphone, and the piezoelectric ceramic sheet is connected to the circuit board through the shell and the conductive polar ring. Consequently, the present microphone is featured by simple structure, small size and convenient assembly, the machining of which can be accomplished by means of production and machining devices and some accessories for electret microphones, thereby reducing production costs of enterprises.

DETAILED DESCRIPTION OF THE PREFERRED EMBODIMENTS

Embodiments of the present invention are further described below in detail in conjunction with the accompanying drawings, but they are not intended to limit the present invention. All of the similar structures employing the present invention, and similar variations thereof, shall be covered by the scope of protection of the present invention, and pause marks in the present invention all refer to coordinative relationships.

Figure 1:
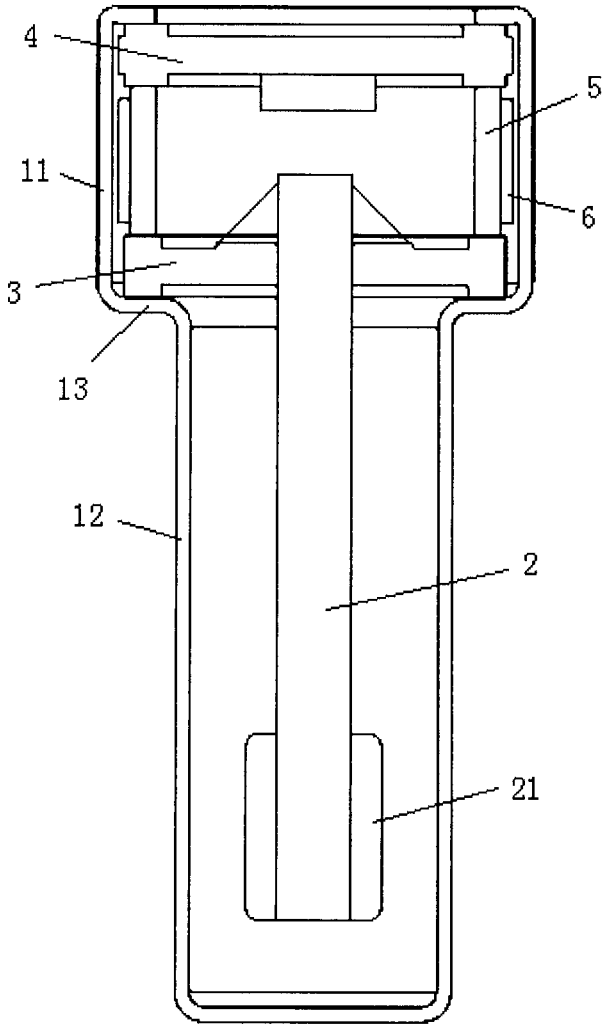
FIG. 1 is a schematic diagram illustrating the structure of a cylindrical contact-type microphone in accordance with an embodiment of the present invention.
Figure 2:
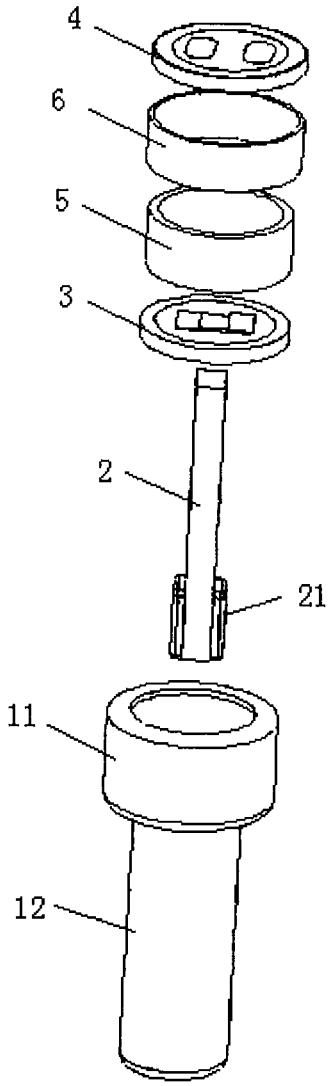
FIG. 2 is an exploded perspective view of the cylindrical contact-type microphone in accordance with an embodiment of the present invention.

As shown in FIGS. 1-2, a cylindrical contact-type microphone provided by the embodiment of the present invention is characterized by comprising a shell and a circuit board 4 mounted within the shell, and it is further characterized by comprising a piezoelectric ceramic sheet 2;

the shell is a tapered, two-section cylindrical conductive cylinder body, a step 13 is formed at a joint portion of an upper cylinder section 11 and a lower cylinder section 12 of the shell, and a lower-stage connection, plate 3 and a conductive polar ring 5 are mounted within the upper cylinder section 11 of the shell;

a via-hole is arranged in the middle of the lower-stage connection plate 3, a positive signal lower connection sheet is secured to an upper plate face edge portion of the lower-stage connection plate 3, and a negative signal lower connection sheet is secured to a lower plate face edge portion of the lower-stage connection plate 3, wherein the negative signal lower connection sheet is pressed against the step 13 at the joint portion of the upper cylinder section and the lower cylinder section of the shell, and forms electrical connection therewith;

the conductive polar ring 5 is an annular conductor, and mounted on the lower-stage connection plate 3; a bottom edge of the conductive polar ring 5 is pressed against the positive signal lower connection sheet on the lower-stage connection plate 3 and forms electrical connection therewith, and the periphery of the conductive polar ring 5 is sleeved with an insulated annular separation ring 6;

the piezoelectric ceramic sheet 2 is inserted into the shell, an upper end of the piezoelectric ceramic sheet 2 passes through the central via-hole of the lower-stage connection plate 3, a positive electrode of the piezoelectric ceramic sheet 2 is connected to the positive signal lower connection sheet of the lower-stage connection plate 3, a negative electrode of the piezoelectric ceramic sheet 2 is connected to the negative signal lower connection sheet of the lower-stage connection plate 3, and a weight block 21 is secured to a lower end of the piezoelectric ceramic sheet 2;

the circuit board 4 is mounted on an upper end of the conductive polar ring 5, a positive signal upper connection sheet is secured to a lower board face of the circuit board 4, and a negative signal upper connection sheet is secured to an upper board face of the circuit board 4, wherein the positive signal upper connection sheet is pressed against an upper edge of the conductive polar ring 5 and forms electrical connection therewith;

an upper edge of the shell is bent inward, and pressed against the negative signal upper connection sheet on the circuit board 4 to form electrical connection therewith.

The working principle of the embodiment of the present invention differs from that of a traditional electret microphone in that an electret diaphragm is replaced with a piezoelectric ceramic sheet, such that a contact-type microphone is accomplished; owing to contact made with an object to collect vibrations thereof, piezoelectric ceramics vibrates and deforms, thereby achieving output of electric signals.

The invention claimed is:

1. A cylindrical contact-type microphone, characterized in that the cylindrical contact-type microphone comprises a shell and a circuit board mounted within the shell, and it is further characterized by comprising a piezoelectric ceramic sheet; wherein the shell is a tapered, two-section cylindrical conductive cylinder body, a step is formed at a joint portion of an upper cylinder section and a lower cylinder section of the shell, and a lower-stage connection plate and a conductive polar ring are mounted within the upper cylinder section of the shell; a via-hole is arranged in the middle of the lower-stage connection plate, a positive signal lower connection sheet is secured to an upper plate face edge portion of the lower-stage connection plate, and a negative signal lower connection sheet is secured to a lower plate face edge portion of the lower-stage connection plate, wherein the negative signal lower connection sheet is pressed against the step at the joint portion of the upper cylinder section and the lower cylinder section of the shell, and forms electrical connection therewith; the conductive polar ring is an annular conductor, and mounted on the lower-stage connection plate; a bottom edge of the conductive polar ring is pressed against the positive signal lower connection sheet on the lower-stage connection plate and forms electrical connection therewith, and the periphery of the conductive polar ring is sleeved with an insulated annular separation ring; the piezoelectric ceramic sheet is inserted into the shell, an upper end of the piezoelectric ceramic sheet passes through the central via-hole of the lower-stage connection plate, a positive electrode of the piezoelectric ceramic sheet is connected to the positive signal lower connection sheet of the lower-stage connection plate, and a negative electrode of the piezoelectric ceramic sheet is connected to the negative signal lower connection sheet of the lower-stage connection plate; the circuit board is mounted on an upper end of the conductive polar ring, a positive signal upper connection sheet is secured to a lower board face of the circuit board, and a negative signal upper connection sheet is secured to an upper board face of the circuit board, wherein the positive signal upper connection sheet is pressed against an upper edge of the conductive polar ring and forms electrical connection therewith; an upper edge of the shell is bent inward, and pressed against the negative signal upper connection sheet on the circuit board to form electrical connection therewith.

2. The cylindrical contact-type microphone of claim 1, characterized in that: a weight block is secured to a lower end of the piezoelectric ceramic sheet.

* * * * *